US010352180B2

(12) United States Patent
Stein et al.

(10) Patent No.: US 10,352,180 B2
(45) Date of Patent: Jul. 16, 2019

(54) GAS TURBINE NOZZLE TRAILING EDGE FILLET

(71) Applicant: General Electric Company, Schenectady, NY (US)

(72) Inventors: Alexander Stein, Greenville, SC (US); Glen Arthur MacMillan, Greenville, SC (US); Thomas Brunt, Greenville, SC (US); Joe Timothy Brown, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1502 days.

(21) Appl. No.: 14/061,095

(22) Filed: Oct. 23, 2013

(65) Prior Publication Data

US 2015/0110616 A1 Apr. 23, 2015

(51) Int. Cl.
*F01D 9/02* (2006.01)
*F01D 9/04* (2006.01)

(52) U.S. Cl.
CPC ..... *F01D 9/02* (2013.01); *F01D 9/041* (2013.01); *F05D 2240/122* (2013.01); *F05D 2250/71* (2013.01); *F05D 2270/17* (2013.01)

(58) Field of Classification Search
CPC . F01D 9/02; F01D 9/041; F01D 5/141; F01D 5/143; F05D 2250/71; F05D 2240/122; F05D 2240/123; F05D 2240/124; F05D 2240/125; F05D 2270/17; F05D 2220/3212
See application file for complete search history.

(56) References Cited

U.S. PATENT DOCUMENTS 4,663,011 A 5/1987 Hinman
4,741,667 A * 5/1988 Price ..... F01D 5/141 415/115
4,826,400 A * 5/1989 Gregory ..... F01D 5/141 415/181

(Continued)

FOREIGN PATENT DOCUMENTS

CN 1847623 A 10/2006
DE 20 2010 015 116 U1 4/2011

(Continued)

OTHER PUBLICATIONS

Booth et al., "Rotor-Tip Leakage: Part 1—Basic Methodology", Journal of Engineering for Power, Transactions of the ASME, vol. 104, Jan. 1982, pp. 154-161.

(Continued)

*Primary Examiner* — Ninh H. Nguyen
*Assistant Examiner* — Wayne A Lambert
(74) *Attorney, Agent, or Firm* — Nixon & Vanderhye P.C.

(57) ABSTRACT

A nozzle segment for a gas turbine engine has a turbine airfoil bound on a first side by an arcuate inner endwall having an inner platform and on a second side by an arcuate outer endwall having an outer platform. The airfoil extends outwardly from the inner platform toward the outer platform. The airfoil body includes opposed pressure and suction sidewalls extending between a leading edge and a trailing edge of the airfoil body. The airfoil body includes a first trailing edge fillet blending into the inner platform at a trailing edge of the airfoil body.

12 Claims, 6 Drawing Sheets

(56) References Cited

U.S. PATENT DOCUMENTS 5,088,892 A * 2/1992 Weingold ..... F01D 5/145 415/193
5,249,922 A * 10/1993 Sato ..... F01D 5/142 415/191
5,282,721 A 2/1994 Kildea
5,779,443 A * 7/1998 Haller ..... F01D 5/141 415/191
6,004,100 A 12/1999 Przirembel et al.
6,072,829 A 6/2000 Dirr
6,079,948 A * 6/2000 Sasaki ..... F01D 5/141 415/191
6,086,328 A 7/2000 Lee
6,142,739 A 11/2000 Harvey
6,158,962 A 12/2000 Lee et al.
6,183,192 B1 * 2/2001 Tressler ..... F01D 5/189 415/115
6,190,128 B1 * 2/2001 Fukuno ..... F01D 5/141 416/223 A
6,419,446 B1 * 7/2002 Kvasnak ..... F01D 5/145 415/116
6,471,474 B1 10/2002 Mielke et al.
6,481,967 B2 11/2002 Tomita et al.
6,491,493 B1 * 12/2002 Watanabe ..... F01D 5/145 415/191
6,506,016 B1 * 1/2003 Wang ..... F01D 5/147 415/173.7
6,524,070 B1 2/2003 Carter
6,612,811 B2 9/2003 Morgan et al.
6,790,005 B2 9/2004 Lee et al.
6,969,232 B2 11/2005 Zess et al.
6,991,428 B2 1/2006 Crane
7,118,329 B2 10/2006 Goodman
7,281,894 B2 10/2007 Lee et al.
7,371,046 B2 * 5/2008 Lee ..... F01D 5/145 415/191
7,491,033 B2 * 2/2009 Trishkin ..... F01D 5/18 29/889.721
7,597,539 B1 10/2009 Liang
7,625,181 B2 * 12/2009 Matsuda ..... F01D 5/145 415/191
7,632,062 B2 12/2009 Harvey et al.
7,931,444 B2 4/2011 Godsk et al.
7,997,875 B2 8/2011 Nanukuttan et al.
8,047,787 B1 11/2011 Liang
8,092,178 B2 1/2012 Marini et al.
8,133,032 B2 3/2012 Tibbott et al.
8,192,153 B2 * 6/2012 Harvey ..... F01D 5/141 415/191
2004/0062636 A1 * 4/2004 Mazzola ..... F01D 5/145 415/115
2004/0081548 A1 4/2004 Zess et al.
2004/0120810 A1 6/2004 Brainch et al.
2006/0083613 A1 4/2006 Cunha et al.
2006/0083614 A1 4/2006 Cunha et al.
2007/0059173 A1 3/2007 Lee et al.
2007/0059182 A1 3/2007 Stegemiller et al.
2007/0128033 A1 6/2007 Lee et al.
2009/0208325 A1 8/2009 Devore et al.
2010/0150710 A1 6/2010 Khanin et al.
2010/0284815 A1 11/2010 Parker et al.
2011/0064580 A1 * 3/2011 Barnes ..... F01D 5/143 416/204 A
2011/0308085 A1 12/2011 Georgieva et al.
2016/0003048 A1 * 1/2016 Gray ..... F01D 5/141 60/805
2016/0123166 A1 * 5/2016 Ols ..... F01D 5/143 415/210.1

FOREIGN PATENT DOCUMENTS

JP 3626899 B2 3/2005
JP 5297228 B2 9/2013

OTHER PUBLICATIONS

Opinion Notice for First Examination and Search issued in connection with corresponding CN Application No. 201410569561.3 dated Dec. 29, 2016.

* cited by examiner

GAS TURBINE NOZZLE TRAILING EDGE FILLET

FIELD OF THE INVENTION

This invention relates generally to gas turbine components (e.g., nozzle segments), and more particularly to turbine airfoils.

BACKGROUND OF THE INVENTION

A gas turbine engine includes a compressor that provides pressurized air to a combustor where the air is mixed with fuel and ignited for generating hot combustion gases. These gases flow downstream to at least one turbine that extracts energy therefrom to power the compressor and provide useful work. The turbine commonly includes a stationary turbine nozzle followed by a turbine rotor.

The turbine nozzle comprises a row of circumferentially side-by-side nozzle segments each including one or more stationary airfoil-shaped vanes mounted between inner and outer band segments defining platforms for channeling the hot gas stream into the turbine rotor. Each of the vanes includes pressure and suction sidewalls that are connected at a leading edge and a trailing edge. The airfoil section typically has a broad, blunt leading edge having a region of high curvature on the suction side transitioning from the leading edge to a thinned trailing edge portion.

Stress (e.g., thermal stress) on the thinned trailing edge portion can lead to undesirable issues on the trailing edge portion at its connection to the platforms which can significantly reduce the life of the nozzle segment.

BRIEF SUMMARY OF THE INVENTION

One exemplary but nonlimiting aspect of the disclosed technology relates to a nozzle segment for a gas turbine engine. The nozzle segment comprises an arcuate inner endwall having an inner platform and an airfoil body extending outwardly from the inner platform toward an arcuate outer endwall. The airfoil body includes opposed pressure and suction sidewalls extending between a leading edge and a trailing edge of the airfoil body and a first inner fillet blending into the inner platform. The first inner fillet has a height, wherein the airfoil body includes a first trailing edge fillet blending into the inner platform at a trailing edge of the airfoil body. The first trailing edge fillet has a height greater than the height of the first inner fillet.

Another exemplary but nonlimiting aspect of the disclosed technology relates to a nozzle segment for a gas turbine engine. The nozzle segment comprises an arcuate inner endwall having an inner platform, an arcuate outer endwall having an outer platform, and an airfoil body extending outwardly from the inner platform and inwardly from the outer platform. The airfoil body includes opposed pressure and suction sidewalls extending between a leading edge and a trailing edge of the airfoil body and a first trailing edge fillet blending into the inner platform at a trailing edge of the airfoil body, wherein a height of the first trailing edge fillet is at least 5% of a total radial length of the airfoil body between the inner and outer platforms. Further, the trailing edge of the airfoil body is locally bowed along a span of the airfoil body so as to form a curved structure in the radial direction of the airfoil body.

BRIEF DESCRIPTION OF THE DRAWINGS

The accompanying drawings facilitate an understanding of the various examples of this technology. In such drawings.

DETAILED DESCRIPTION OF THE ILLUSTRATED EMBODIMENTS

Figure 1:
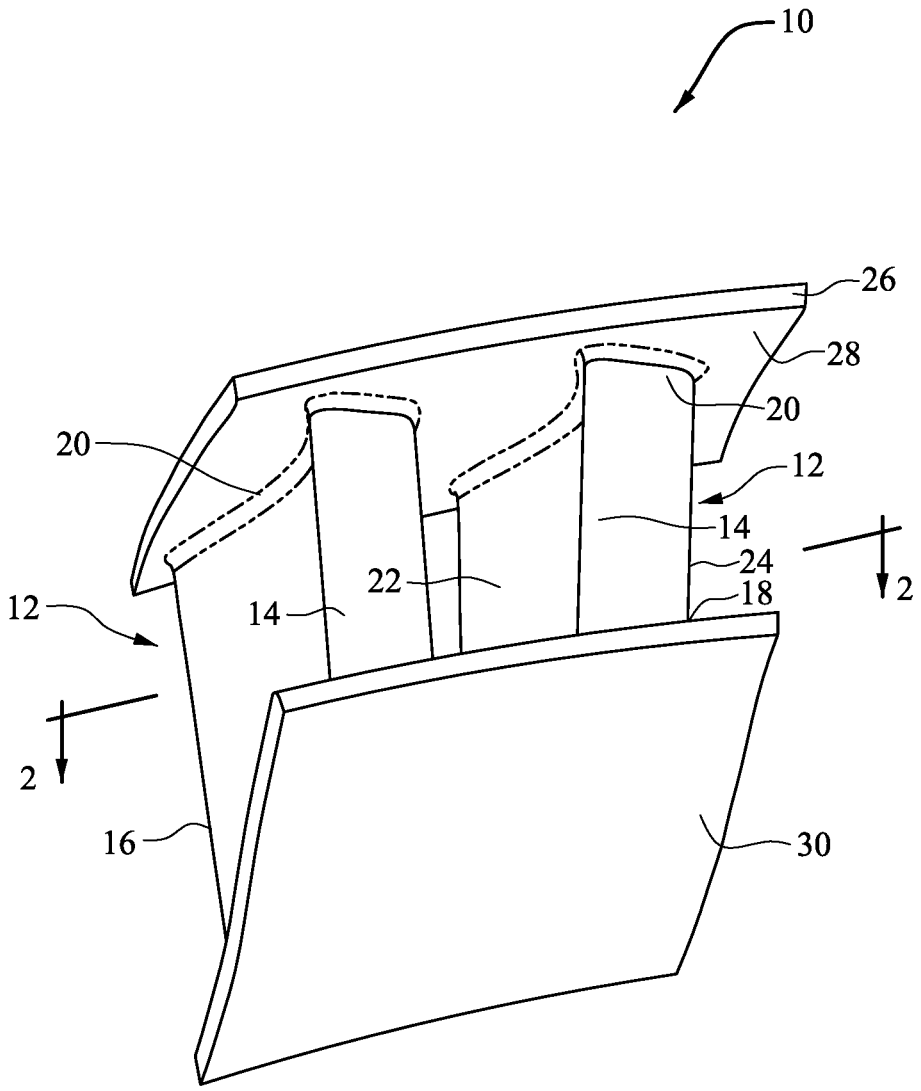
FIG. 1 is a perspective view of an turbine nozzle segment according to an example of the disclosed technology.
Figure 2:
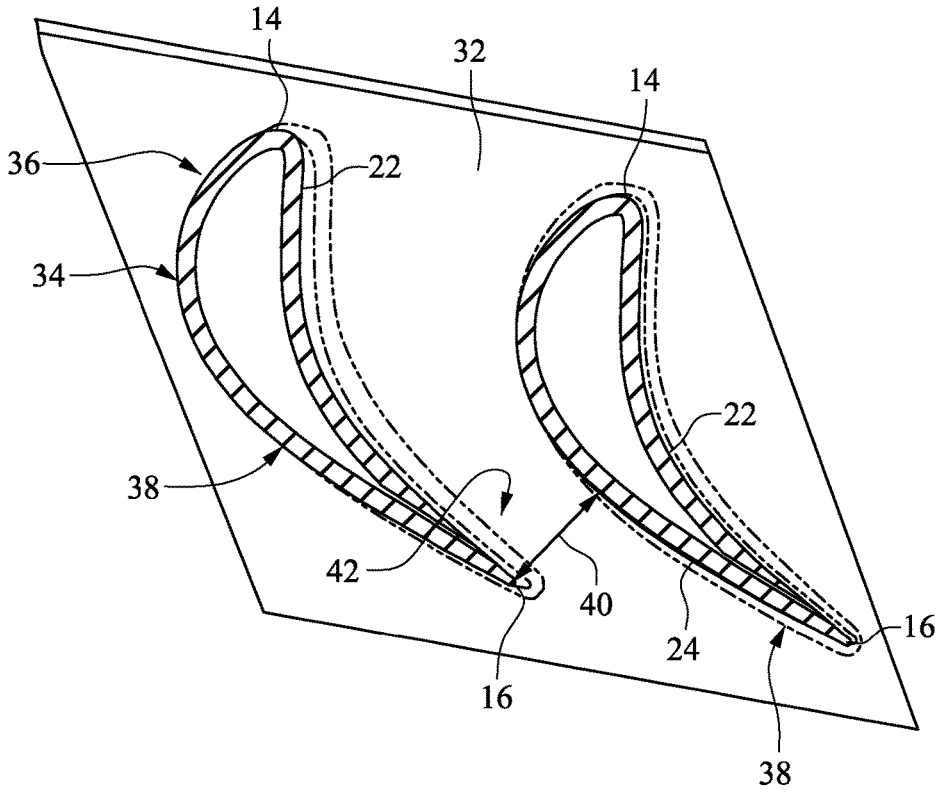
FIG. 2 is a cross-sectional view taken along the line 2-2 in FIG. 1.
Figure 3:
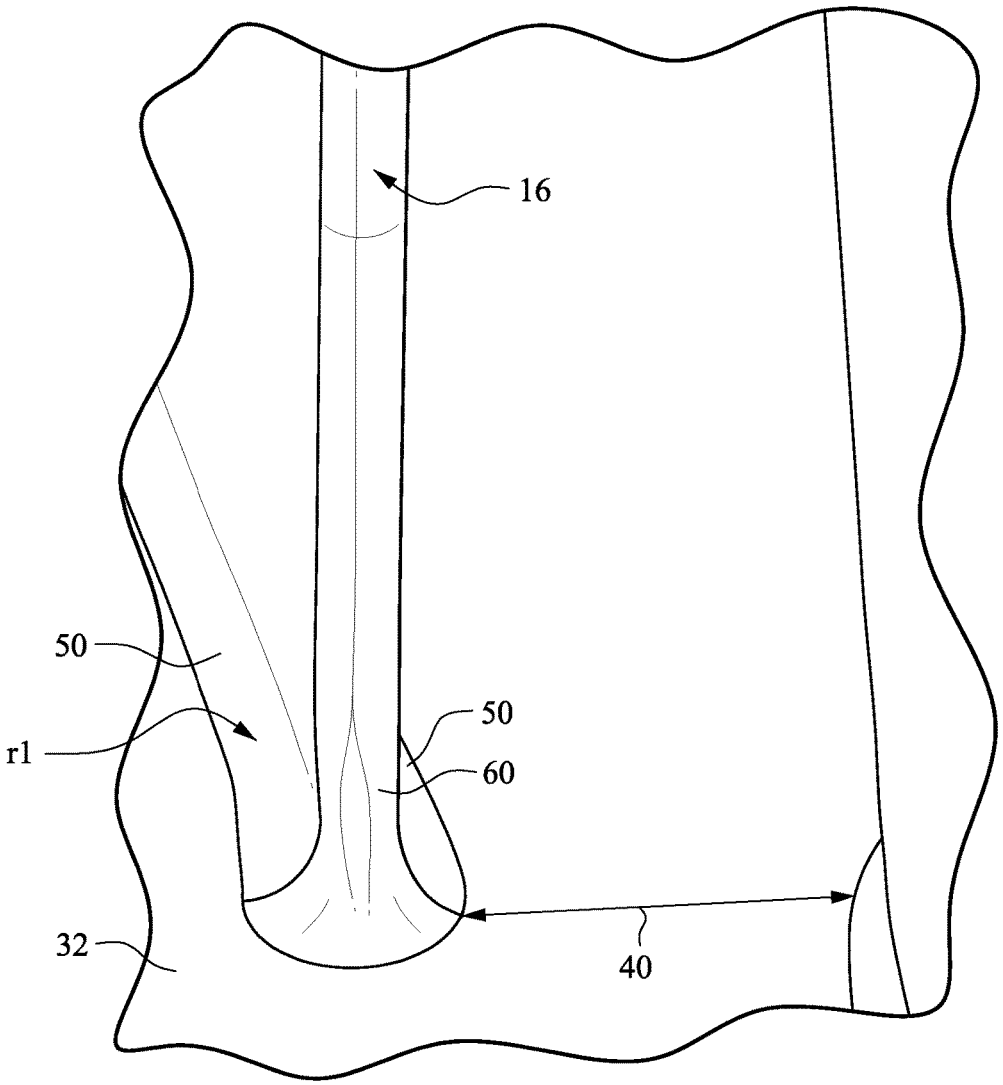
FIG. 3 is a partial perspective view of a trailing edge of a vane of the nozzle segment of FIG. 1.

Referring to FIGS. 1-3, an exemplary nozzle segment 10 in accordance with an example of the disclosed technology is shown. A plurality of such nozzle segments 10 are assembled in circumferential side-by-side fashion to build up a turbine nozzle. The nozzle segment 10 includes one or more airfoils or vanes 12 each having a leading edge 14, a trailing edge 16, a root 18, a tip 20, and spaced-apart pressure and suction sidewalls 22 and 24, respectively. An arcuate outer endwall 26 having an outer platform 28 is attached to the tips 20 of the vanes 12. An arcuate inner endwall 30 having an inner platform 32 is attached to the roots 18 of the vanes 12. The outer and inner endwalls 26 and 30 define the outer and inner radial boundaries, respectively, of the primary gas flowpath through the nozzle segment 10.

The nozzle segment 10 is typically formed from a high-temperature capable metallic alloy such as known nickel or cobalt-based "superalloys." The nozzle segment may be cast as a single unit, or it may be assembled from individual components or sub-assemblies.

FIG. 2 is a cross-sectional view taken along the line 2-2 in FIG. 1 and illustrates the airfoil section of the vanes 12. The suction sidewall 24 of each vane 12 extends rearward from the leading edge 14, and has a high curvature section 34 between relatively less curved forward and aft portions 36 and 38, respectively, of the suction sidewall 24.

A throat 40 defining the minimum cross-sectional flow area is defined between an aft portion 42 of the pressure sidewall of vane 12 and the aft portion 38 of the suction sidewall 24 of an adjacent vane 12. The area of the throat 40 is a key dimension affecting the aerodynamic performance of the nozzle segment 10. It is therefore desirable to maintain the actual area of the throat 40 as close as possible to the intended design value.

As shown in FIG. 3, the vane 12 includes an inner fillet 50 near the inner platform 32. The inner fillet 50 forms a concave portion that blends into the platform 32. The inner fillet 50 may extend around the entire periphery of the vane 12. The inner fillet 50 may have a simple curved cross-sectional profile having any suitable radius of curvature r1 and a height d1 as those skilled in the art will recognize.

Figure 4:
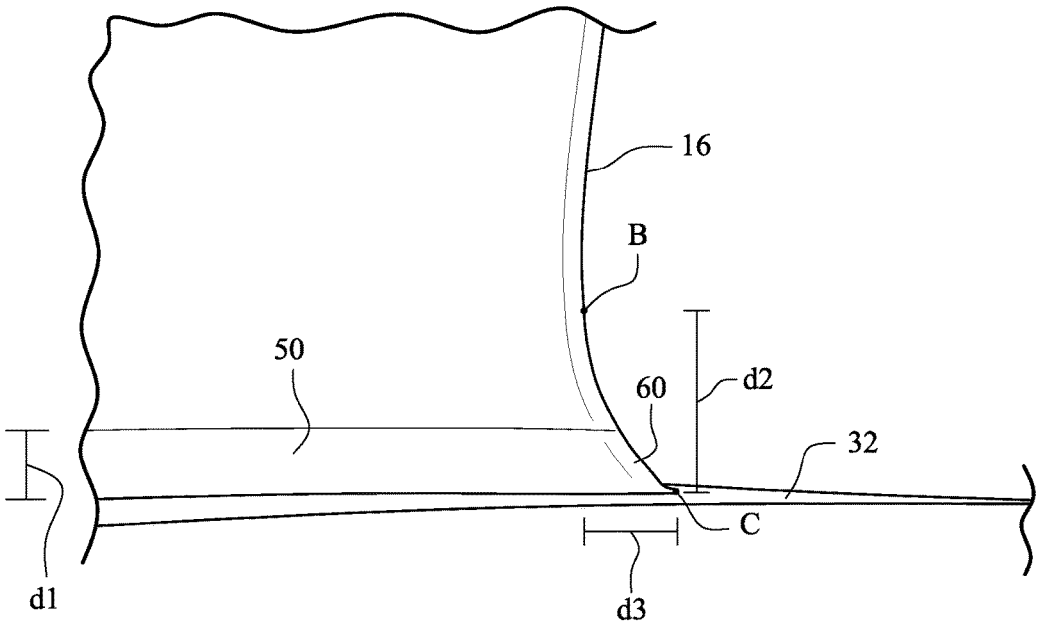
FIG. 4 is a partial side view of a trailing edge portion of the vane of FIG. 3 near an inner endwall.

In the illustrated example, a trailing edge fillet 60 is disposed at the trailing edge 16 of the vane 12 between opposing end portions of the inner fillet 50, as shown in FIGS. 3 and 4. The trailing edge fillet 60 has an increased height d2 as compared to the height d1 of the inner fillet 50. As shown in FIG. 4, the height d2 is measured from a transition point B where the trailing edge fillet 60 blends into the trailing edge of the vane 12, as those skilled in the art will understand. The trailing edge fillet 60 is taller than conventional fillets. Specifically, the height d2 of the trailing edge fillet 60 is greater than 5% (e.g., 5% to 20%) of the total radial extent or length (height) of the vane 12 from the inner platform 32 to the outer platform 28. Preferably, the height d2 is greater than 10% (e.g., 15%) of the height of the vane 12.

The trailing edge fillet 60 may also have an increased width d3 as compared to a similar dimension of the inner fillet 50 (or a conventional fillet). As shown in FIG. 4, the width d3 is measured from the transition point B to an end point C of the trailing edge fillet. Preferably, the width d3 is 80% to 300% of the height d2. The curved segment BC is modeled as a conic segment in accordance with the particular lengths of d2 and d3 and having a rho value within the range of 0.3-0.5, as one skilled in the art will understand.

Figure 5:
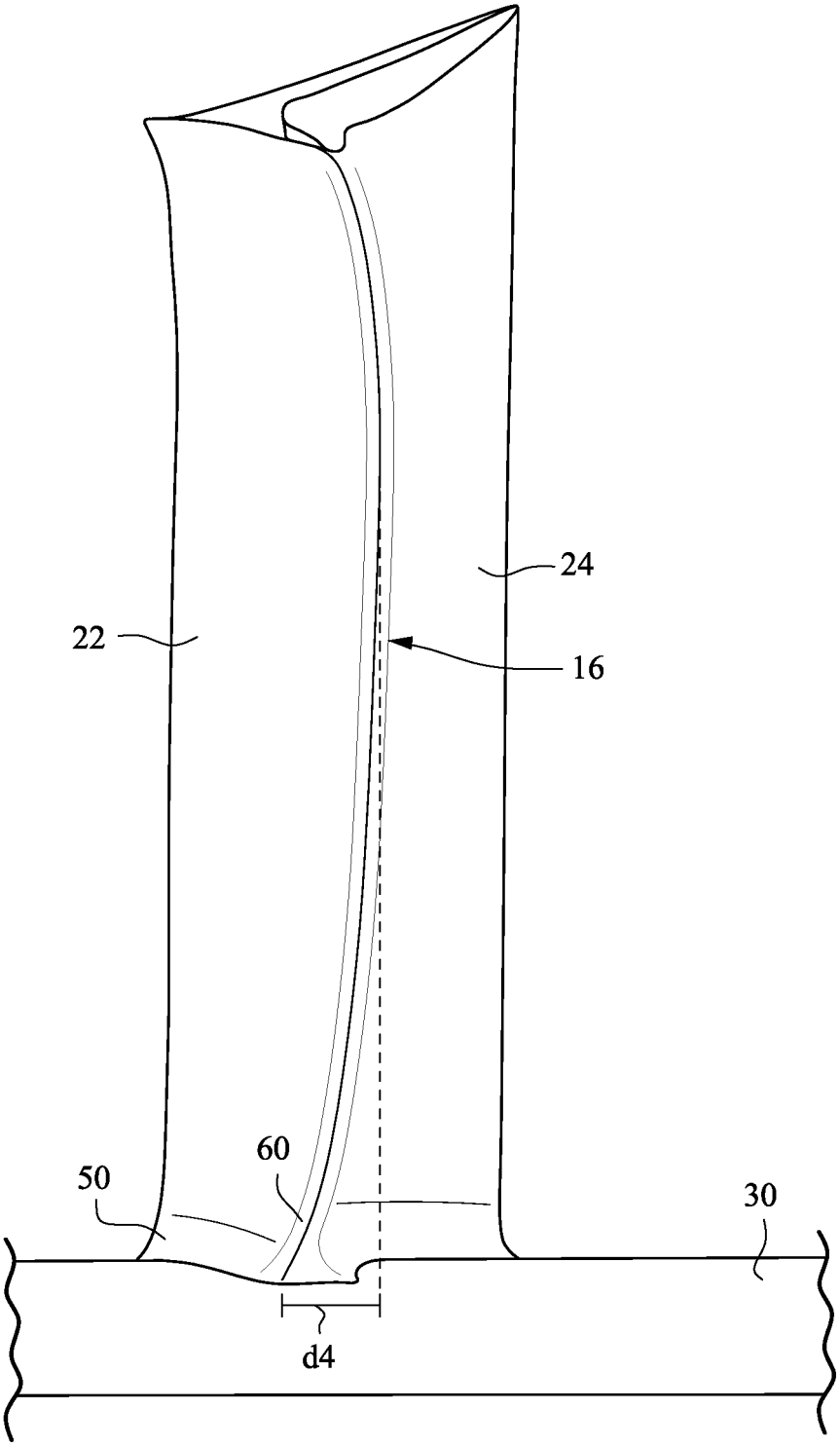
FIG. 5 is a partial perspective view of a trailing edge of a vane having a bowed trailing edge portion in accordance with an example of the disclosed technology.

Due to the width d3 of the trailing edge fillet 60, the chord length of the inner endwall 32 is increased thereby reducing the local throat 40. In order to maintain the spanwise throat distribution, the trailing edge sections of the vanes 12 are bowed along the radial direction of the vanes 12, as shown in FIG. 5. That is, the trailing edge portion of the vane 12 is bowed so as to preserve the intended size of the throat. This causes the nozzle trailing edge 16 to be locally bowed thus preserving the throat width and thereby leading to a reduction in secondary flows (i.e., increased aerodynamic efficiency).

The trailing edge 16 of the vane 12 at its connection to the inner endwall 30 may be offset by a distance d4 from the point at which the trailing edge 16 connected to the inner endwall 30 before bowing (or from a radially extending line through a point on the trailing 16 circumferentially farthest from the trailing edge/inner endwall connection). The offset d4 may be within a range of 3-6% of the total radial extent (height) of the vane 12 from the inner platform 32 to the outer platform 28.

Figure 6:
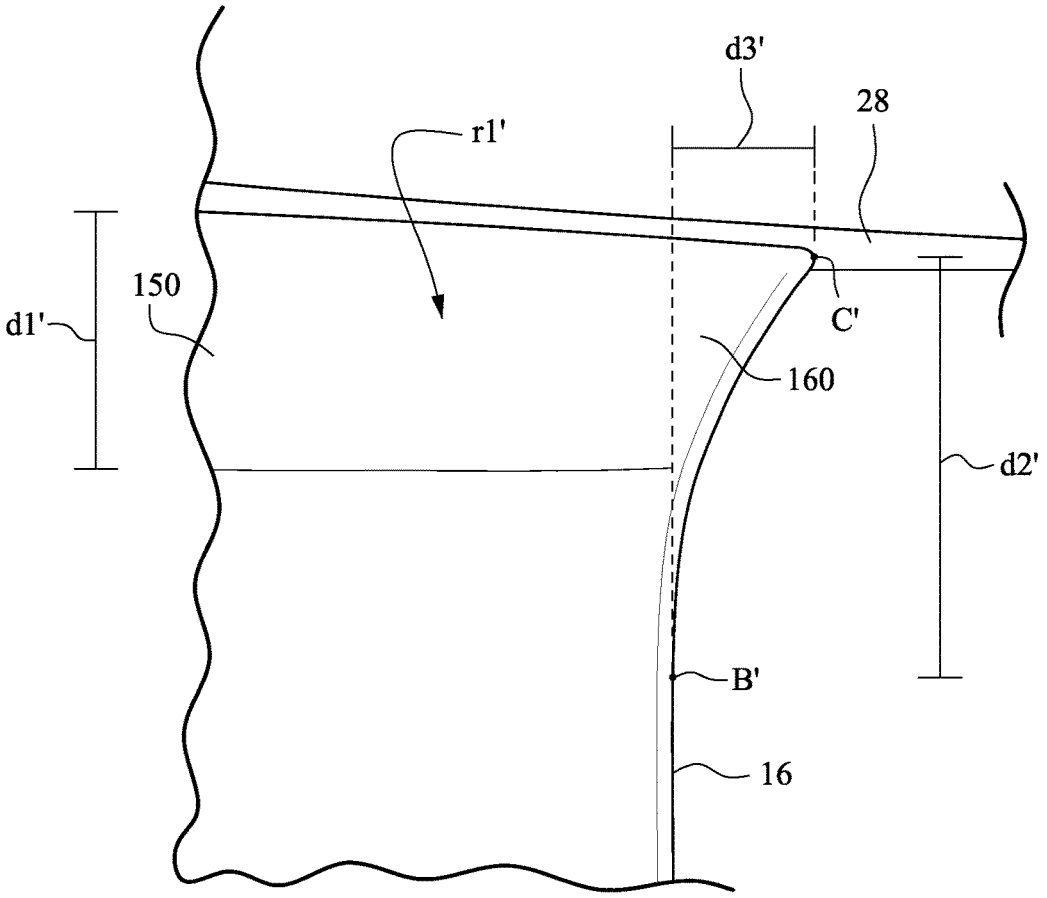
FIG. 6 is a partial side view of a trailing edge portion of a vane near an outer endwall in accordance with an example of the disclosed technology.

FIG. 6 illustrates a trailing edge portion of a vane 12 near the outer endwall 26. Similar to the intersection of the vane 12 and the inner endwall 30, the vane 12 may have fillets in order to blend into the outer endwall 26.

As shown in FIG. 6, the vane 12 includes an outer fillet 150 near the outer platform 28 and a trailing edge fillet 160. The outer fillet 150 and the trailing edge fillet 160 are similar to the inner fillet 50 and the trailing edge fillet 60 described above. The ranges for the dimensions d1', d2', d3' and r1' are respectively the same as the dimensions d1, d2, d3 and r1 described above. Similarly, the curved segment B'C' is modeled in the same manner as the segment BC above. It is noted however that the particular values of the dimensions d1', d2', d3' and r1' as well as the shape of the segment B'C' may be different from the values of the dimensions d1, d2, d3 and r1 and the shape of the segment BC.

The trailing edge 16 of the vane 12 may also be bowed near the outer endwall 26, as shown in FIG. 5. The offset of the bow at the outer endwall 26 may be within the same range as the offset d4 of the bow at the inner endwall 30.

The larger trailing edge fillets 60, 160 increase the cross-sectional area at the junctions between the vanes 12 and the inner and outer platforms 32 and 28 and thus cause the vanes to better withstand stress. The trailing edge fillets cause a reduction in the amount of cracking at the trailing edge junction over the life of the nozzle segment, thus significantly increasing the useful life of the nozzle segment. Further, by bowing the trailing edge junction portions, the throat is maintained and therefore aerodynamic efficiency is not sacrificed.

While the invention has been described in connection with what is presently considered to be the most practical and preferred examples, it is to be understood that the invention is not to be limited to the disclosed examples, but on the contrary, is intended to cover various modifications and equivalent arrangements included within the spirit and scope of the appended claims.

What is claimed is:

1. A nozzle segment for a gas turbine engine, comprising:

an arcuate inner endwall having an inner platform;

an arcuate outer endwall; and an airfoil body attached to and extending outwardly from the inner platform to the arcuate outer endwall, the airfoil body being attached to the arcuate outer endwall and including opposed pressure and suction sidewalls extending between a leading edge and a trailing edge of the airfoil body, the airfoil body including a first inner fillet blending into the inner platform, the first inner fillet having a height, and the airfoil body including a first trailing edge fillet blending into the inner platform at a trailing edge of the airfoil body, the first trailing edge fillet having a height greater than the height of the first inner fillet.

2. The nozzle segment according to claim 1, wherein the first inner fillet extends along a periphery of the airfoil body and is connected to the first trailing edge fillet at the trailing edge of the airfoil body such that the first trailing edge fillet is disposed between opposing end portions of the first inner fillet.

3. The nozzle segment according to claim 2, wherein the trailing edge of the airfoil body is locally bowed along a span of the airfoil body.

4. The nozzle segment according to claim 3, wherein a connection between the trailing edge of the airfoil body and the inner platform is offset from a radially extending line through a point along the trailing edge which is circumferentially farthest from the connection.

5. The nozzle segment according to claim 4, wherein the connection is offset by a distance within a range of 3-6% of the total radial length of the airfoil body between the inner and outer platforms.

6. The nozzle segment according to claim 1, wherein the height of the first trailing edge fillet is at least 5% of a total radial length of the airfoil body between the inner and outer endwalls.

7. The nozzle segment according to claim 6, wherein the height of the first trailing edge fillet is at least 10% of the total radial length of the airfoil body between the inner and outer endwalls.

8. The nozzle segment according to claim 7, wherein the height of the first trailing edge fillet is about 15% of the total radial length of the airfoil body between the inner and outer endwalls.

9. The nozzle segment according to claim 1, wherein a width of the first trailing edge fillet is within a range of 80% to 300% of the height of the first trailing edge fillet.

10. The nozzle segment according to claim 9, wherein the width of the first trailing edge fillet is within a range of 130% to 225% of the height of the trailing edge fillet.

11. The nozzle segment according to claim 1, wherein the arcuate outer endwall has an outer platform, wherein the airfoil body extends inwardly from the outer platform, the airfoil body includes a second outer fillet blending into the outer platform, the second outer fillet having a height, and wherein the airfoil body includes a second trailing edge fillet blending into the outer platform at a trailing edge of the airfoil body, the second trailing edge fillet having a height greater than the height of the second outer fillet.

12. A gas turbine, comprising:

a combustor section to produce a high temperature gas stream; and a turbine section driven by the high temperature gas stream, wherein the turbine section includes the nozzle segment of claim 1.

* * * * *